United States Patent [19]

Hakansson

[11] 3,940,934

[45] Mar. 2, 1976

[54] STIRLING ENGINES

[75] Inventor: Sven Anders Samuel Hakansson, Malmo, Sweden

[73] Assignee: Kommanditbolaget United Stirling (Sweden) AB & Co., Malmo, Sweden

[22] Filed: June 4, 1973

[21] Appl. No.: 366,422

Related U.S. Application Data

[63] Continuation of Ser. No. 181,870, Sept. 20, 1971.

[52] U.S. Cl. ..... 60/525; 60/526

[51] Int. Cl.[2] ..... F02G 1/04

[58] Field of Search ..... 60/525, 526

[56] References Cited

UNITED STATES PATENTS

| | | | |
|---|---|---|---|
| 2,590,662 | 3/1952 | Van Weenen | 60/525 |
| 2,616,245 | 11/1952 | Van Weenen | 60/525 |
| 2,817,950 | 12/1957 | Van Weenen et al. | 60/525 |
| 3,527,049 | 9/1970 | Bush | 60/525 X |

*Primary Examiner*—Allen M. Ostrager
*Attorney, Agent, or Firm*—Laurence R. Brown

[57] ABSTRACT

An internal combustion Stirling V-engine is disclosed having individual heat exchangers for each cylinder disposed between two adjacent cylinders. A central preheater is disposed centrally between the cylinders in the V-space to vertically overlap the cylinder heat exchanger span.

2 Claims, 4 Drawing Figures

INVENTOR.
SVEN A. S. HÅKANSSON
BY
Laurence R. Brown
Attorney

INVENTOR.
SVEN A. S. HÅKANSSON
BY
Laurence R. Brown
Attorney

STIRLING ENGINES

This is a continuation of application Ser. No. 181,870 filed Sept. 20, 1971.

This invention relates to a multi-cylinder Stirling engine of the kind (herein called "the kind defined") in which each piston acts as a power piston and a displacer simultaneously.

The present invention is intended to provide an engine of the kind defined which is economical in manufacture and service, which is compact, and which has a low weight thus making it suitable for use in the light automotive industry.

According to the present invention an engine of the kind defined is constructed as a V-engine having a single crank-shaft with heat-exchanger units equal in number to the cylinders disposed between the cylinders, a heat-exchanger unit being located between each two respective adjacent cylinders.

Preferably a single heater unit is disposed centrally relative to the cylinders and said heat-exchangers, the heater unit extending downwardly so as to partly overlap the cylinders and heat-exchangers in the vertical direction.

Figure 1:
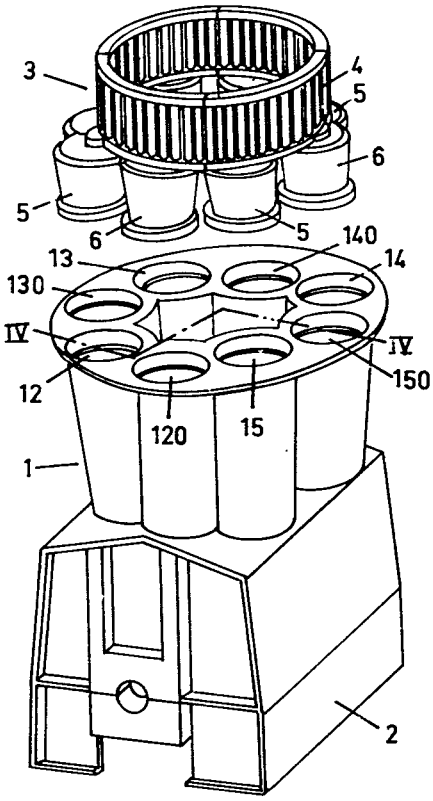
Figure 2:
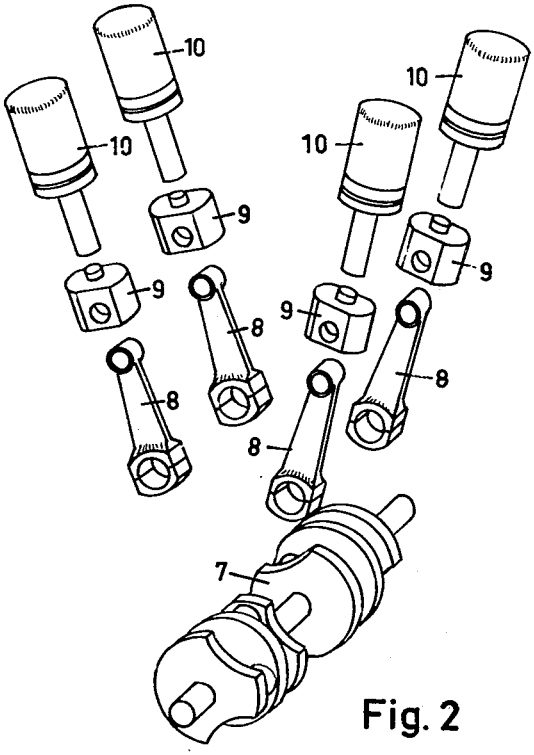
Figure 3:
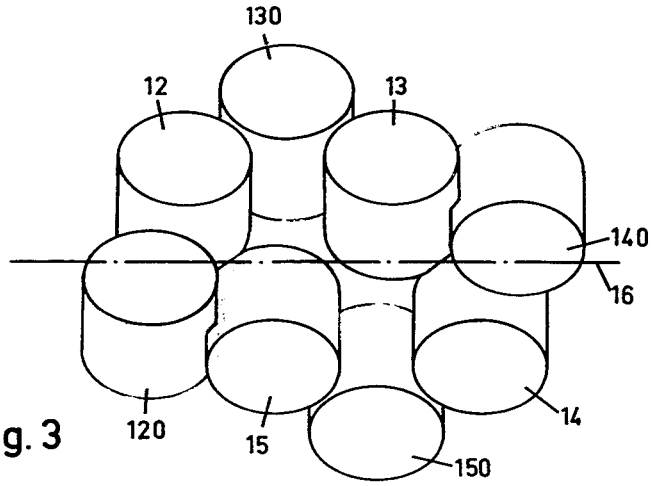
Figure 4:
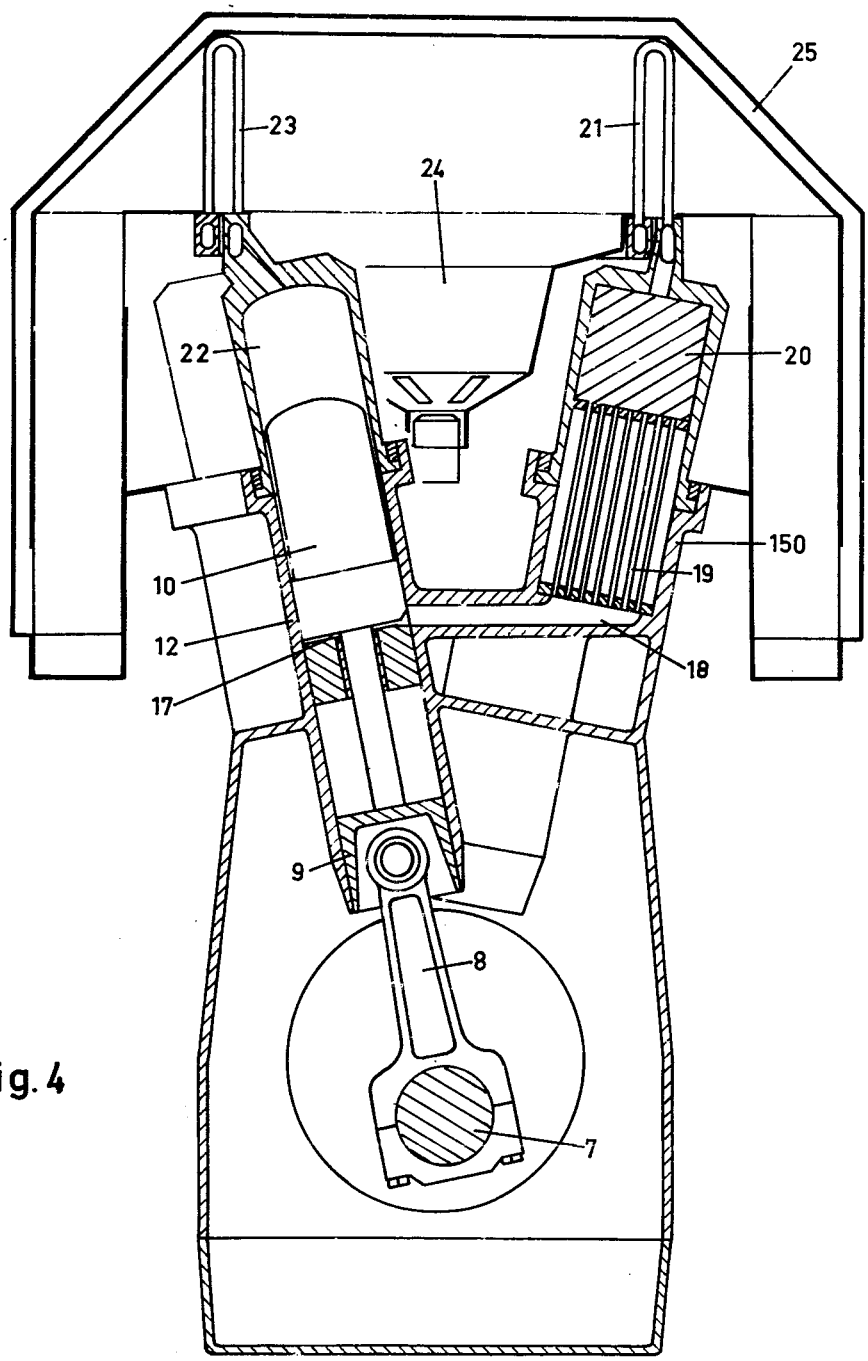

An engine in accordance with the invention is illustrated in the accompanying drawings, in which FIG. 1 shows a schematic perspective view of the main parts of the Stirling engine, FIG. 2 is an exploded view showing the pistons, cross-heads, connecting-rods, and the crank-shaft to be used in the engine shown in FIG. 1, FIG. 3 schematically shows the relative positions of cylinders and heat-exchangers in the engine as viewed from above, and FIG. 4 is a vertical section through the engine along the line IV—IV in FIG. 1.

Referring to FIGS. 1 and 2, an engine block 1 is connected to a crank casing 2. A unit 3 comprising heater elements 4 and cylinder heads 5 and heat-exchanger heads 6 is shown separated from the engine block 1. The engine is provided with an ordinary crank-shaft 7 driven by four connecting-rods 8, each of which is connected to a cross-head 9 and a piston 10.

The engine block 1 contains four cylinders 12, 13, 14, and 15 and four heat-exchangers located in cylindrical cavities 120, 130, 140 and 150.

FIG. 3 shows schematically the relative positions of the four cylinders 12, 13, 14 and 15 and the four heat-exchanger cavities in the engine block as viewed from above the geometrical axis of the crank-shaft being indicated by a dash-dotted line 16.

Each of the working cycles in the four cylinders 12, 13, 14 and 15 is displaced through a time interval corresponding to a crank-shaft rotation of 90° relative to the cycle in the preceding and the following cylinder.

As shown in FIG. 4 the space 17 below the piston 10 is connected through a channel 18 to a heat-exchanger having a cooler 19 and a regenerator 20. The top of the heat-exchanger is connected to heater tubes 21.

As illustrated in FIG. 4, and as will be understood from FIG. 1, the space below the piston in cylinder 12 is connected to heat-exchanger 150. Consequently, the space below the piston in the cylinder 13 is connected to the heat-exchanger 120 — the space below the piston of cylinder 14 is connected to heat-exchanger 130 — and the space below piston of cylinder 15 is connected to heat-exchanger 140.

The space 22 above the piston 10 of the cylinder 12 is connected to heater tubes 23. The tubes of the unit 3 are divided into four sections, (see FIG. 1), each section being sealed from the other sections. The tubes communicating with cylinder 12 also communicate with the heat-exchanger 120 and form one section. Likewise a section of heater tubes connects the top of the cylinder 13 with the top of the heat-exchanger 130 — a third section of tubes connects the top of the cylinder 14 with the top of the heat-exchanger 140 — and finally the fourth section of tubes connects the top of the cylinder 15 with the top of the heat-exchanger 150.

It will be understood that the space between the cylinders and the heat-exchangers accommodates a central part 24 of a burner and pre-heater device 25, and thus the total height of the engine is reduced. The compact design and the substantial use of conventional elements makes the engine suitable as power source for passenger cars or road vehicles.

The single heater unit 24 – 25 is disposed centrally relative to the cylinders 12, 13, 14, and 15 and heat-exchangers 120, 130, 140, and 150, and extends downwardly so as to partially overlap the cylinders and heat-exchangers in the vertical direction.

What we claim is:

1. A Stirling engine arrangement comprising in combination, a single-crank shaft, a plurality of at least four cylinders disposed along paths forming a V-arrangement extending from said crank-shaft, each cylinder containing a piston dividing the cylinder into a high temperature region and a low temperature region the low temperature region being located adjacent the crotch of said V-arrangement, a separate regenerator-cooler unit connected to each cylinder and disposed in said V-arrangement in a location positioned between said two adjacent ones of said cylinders to place each cylinder and its regenerator-cooler adjacent each other near the crotch of said V-arrangement with the low temperature part of one cylinder being connected by a working gas flow channel to the cooler portion of the regenerator-cooler unit and with the high temperature part of another cylinder located adjacent thereto connected by heater tubes to the regenerator portion of the regenerator-cooler unit, said working gas flow channel connecting each said cylinder to its adjacent heat exchanger unit through a short passageway near the crotch of said V-arrangement, said heater tubes disposed in an array about said cylinders at the high temperature region away from the crotch of said V-arrangement to define inside the V-arrangement between the cylinders a heating space, and a single burner unit being mounted in said heating space for heating the heater tubes for each of said cylinders.

2. An engine as defined in claim 1 wherein said burner unit at least partially overlaps the position of the cylinders and regenerator-cooler units within the V-arrangement.

* * * * *